United States Patent [19]

Kurihara

[11] 4,149,499

[45] Apr. 17, 1979

[54] VACUUM CONTROLLED IGNITION TIMING APPARATUS FOR INTERNAL COMBUSTION ENGINE

[75] Inventor: Norimitsu Kurihara, Wako, Japan

[73] Assignee: Honda Giken Kogyo Kabushiki Kaisha, Tokyo, Japan

[21] Appl. No.: 776,354

[22] Filed: Mar. 10, 1977

Related U.S. Application Data

[63] Continuation-in-part of Ser. No. 642,712, Dec. 22, 1975, abandoned.

[30] Foreign Application Priority Data

Dec. 26, 1974 [JP] Japan ..... 49-156849

[51] Int. Cl.[2] ..... F02P 5/10

[52] U.S. Cl. ..... 123/117 A; 123/117 R

[58] Field of Search ..... 123/117 A, 117 R, 146.5 A

[56] References Cited

U.S. PATENT DOCUMENTS

| | | | |
|---|---|---|---|
| 3,272,191 | 9/1966 | Walker | 123/117 A |
| 3,603,298 | 9/1971 | Toda et al. | 123/117 A |
| 3,650,253 | 3/1972 | Cooksey | 123/117 A |
| 3,687,120 | 8/1972 | Lenz | 123/146.5 A |
| 3,704,697 | 12/1972 | Weymann | 123/117 A |
| 3,804,326 | 4/1974 | McIntire | 123/117 A |
| 3,885,535 | 5/1975 | Walker | 123/117 A |
| 3,978,831 | 9/1976 | Yoshikawa | 123/117 A |
| 4,027,633 | 6/1977 | Otsubo et al. | 123/117 R |
| 4,051,823 | 10/1977 | Mogi et al. | 123/117 A |

*Primary Examiner*—Charles J. Myhre
*Assistant Examiner*—Andrew M. Dolinar
*Attorney, Agent, or Firm*—Lyon and Lyon

[57] ABSTRACT

Ignition timing control apparatus for an internal combustion spark ignition engine employs a vacuum actuator having a movable element positioned between first and second vacuum chambers and arranged to advance or retard the spark timing. A single three-way control valve, electrically operated, serves to connect one of the vacuum chambers to engine intake vacuum pressure and to vent the other vacuum chamber to atmosphere, depending on speed of the vehicle driven by the engine. A temperature responsive valve cuts off engine intake vacuum pressure to the three-way control valve when the ambient temperature drops below a predetermined level.

2 Claims, 1 Drawing Figure

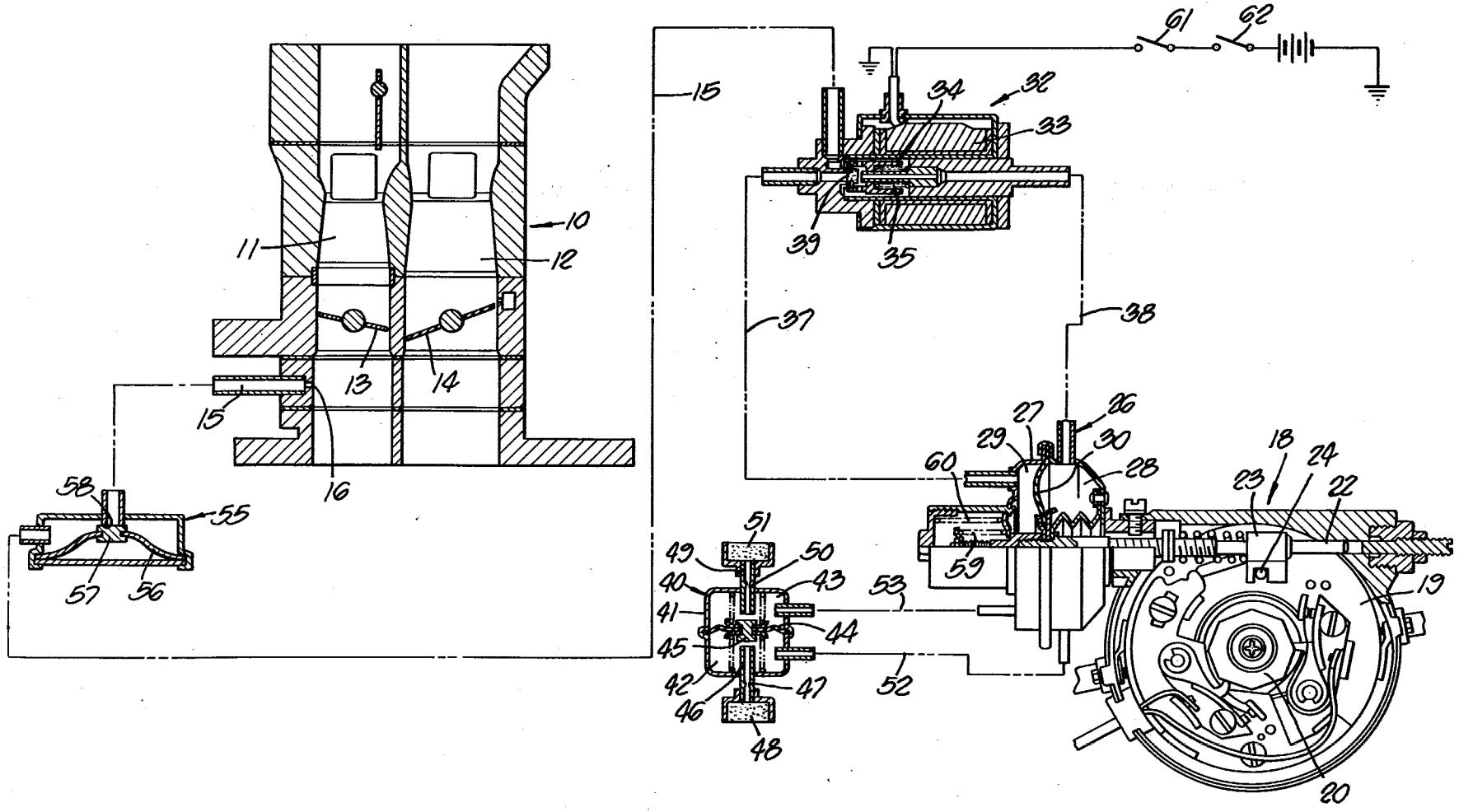
10
11
12
13
14
15
16
18
19
20
22
23
24
26
27
28
29
30
32
33
34
35
37
38
39
40
41
42
43
44
45
46
47
48
49
50
51
52
53
55
56
57
58
59
60
61
62

VACUUM CONTROLLED IGNITION TIMING APPARATUS FOR INTERNAL COMBUSTION ENGINE

RELATED APPLICATION

This is a continuation-in-part of United States Patent Application Ser. No. 642,712 filed Dec. 22, 1975, abandoned.

This invention relates to apparatus for controlling ignition timing of an internal combustion engine by means of a vacuum response device having a first vacuum chamber for moving an element in one direction to advance the spark timing, and having another vacuum chamber for moving the same element in the other direction to retard the spark timing. Apparatus of this general type requires that one vacuum chamber be subjected to engine intake vacuum while the other is vented to atmosphere, and vice versa. In conventional practice this has been accomplished by employing two three-way control valves, one for each vacuum chamber, together with apparatus for coordinating their operation. Such a system has been found to be objectionably large in size, relatively complicated as a whole, and consequently expensive.

An important object of this invention is to provide spark timing control apparatus for an internal combustion engine, which apparatus connects engine intake vacuum pressure to either side of a vacuum response member, but which is free of the disadvantages described above and which uses only one three-way control valve instead of two. The three-way valve is electrically operated in accordance with speed of a vehicle driven by the engine. The valve serves to connect engine intake vacuum pressure to either one or two vacuum chambes formed on opposite sides of a flexible diaphragm arranged to advance or retard the spark timing. At the time either one of the vacuum chambers is connected to engine intake vacuum pressure, the atmospheric vent is closed, and the other vacuum chamber is connected to atmosphere through a restricted orifice. In addition, a temperature sensitive valve closes at low temperature to cut off the supply of engine intake vacuum pressure to the three-way control valve.

Other objects and advantages will appear hereinafter.

The drawing is in schematic form, partly in section, and shows a preferred embodiment of this invention.

Referring to the drawing, the internal combustion spark ignition engine is provided with a carburetor generally designated 10 having intake passages 11 and 12 controlled by throttle valves 13 and 14, respectively. A vacuum conduit 15 communicates with the engine intake passage 11 downstream from the throttle valve 13 through the restriction opening 16. A spark timing control device generally designated 18 includes a point base 19 mounted to turn about the axis of the rotary point cam 20 which is driven by the engine. A vacuum response member comprises a slide rod 22 having a fork member 23 fixed thereto and arranged to move a pin 24 fixed to the point base 19, so that movement of the slide rod 22 toward the right, as shown in the drawing, causes the point base 19 to turn in a clockwise direction to advance the spark timing. Movement of the slide rod 22 toward the left serves to retard the spark timing.

A vacuum actuator 26 has a housing 27 divided into a first vacuum chamber 28 and a second vacuum chamber 29 by means of the flexible diaphragm 30. The outer peripheral portion of the flexible diaphragm 30 is fixed to the stationary housing 27, and the central portion of the flexible diaphragm 30 is fixed with respect to the slide rod 22. A flexible bellows 31 forms the inner portion of the first vacuum chamber 28 and serves to prevent leakage.

The three-way control valve generally designated 32 is electrically operated and contains a solenoid coil 33 which, when energized, causes the movable armature 34 to move toward the right, as shown in the drawing, against the action of the coil compression spring 35. When the armature 34 is moved to the right, the vacuum conduit 15 is connected to the second vacuum chamber 29 through line 37. When the armature 34 returns to the left under force of the spring 35 upon de-activation of the solenoid coil 33, the vacuum conduit 15 is connected to the first vacuum chamber 28 and through the line 38. When the movable armature 34 is in the left-hand position shown in the drawing, the valve head 39 closes the conduit 37 and connects the vacuum conduit 15 to the conduit 38. When the valve head 39 is in the right-hand position, the conduit 38 is closed, and the vacuum conduit 15 is connected to conduit 37.

A vent valve assembly generally designated 40 includes a housing 41 divided into a first chamber 42 and a second chamber 43 by means of a flexible diaphragm 44 carrying a centrally positioned valve head 45. A first vent tube 46 has a restricted opening 47 and serves to connect the first chamber 42 to atmosphere through filter 48. Similarly, the second vent tube 49 has a restricted opening 50 and serves to connect the second chamber 43 to atmosphere through the filter 51. The first chamber 42 is connected to the first vacuum chamber 28 by means of the conduit 52, and the second chamber 43 is connected to the second vacuum chamber 29 through the conduit 53.

When the first vacuum chamber 28 is subjected to vacuum pressure through the three-way control valve 32 and conduit 38, this vacuum pressure is applied to the first chamber 42 and causes the flexible diaphragm 44 to move the valve head 45 to close the first vent tube 46. At the same time the second vacuum chamber 29 is vented to atmosphere through conduit 53, second vent tube 49 and restricted opening 50. Similarly, when the second vacuum chamber 29 is subjected to vacuum pressure through the three-way control valve 28 and conduit 37, the flexible diaphragm 44 causes the valve head 45 to close the second vent tube 49. At that time the first vacuum chamber 28 is vented to atmosphere through conduit 52, first vent tube 46 and restricted opening 47. The vacuum restriction 16 is larger than the restricted openings 47 and 50.

A temperature sensitive valve assembly 55 is mounted in the vacuum conduit 15 and acts to close the conduit 15 whenever the engine temperature falls below a predetermined level. A bimetal element 56 moves a valve head 57 to close against valve seat 58 at such low temperatures. This cuts off the supply of vacuum pressure to the three-way control valve 32, and hence to either of the vacuum chambers 28 or 29. In this situation, the slide rod 22 is returned to neutral position by the action of the coil springs 59 and 60.

The switch 61 closes when the vehicle speed decreases. It is recognized, however, that this switch 61 could close in response to another engine operating condition, for example, engine RPM, or engine temperature or vehicle cruising operation.

In operation, when the vehicle speed is relatively low and the vehicle speed switch 61 is closed and the ignition switch 62 is closed, the three-way control valve 32 acts to connect intake vacuum pressure to the second vacuum chamber 29. This causes the slide rod 22 to move to the left to retard the spark timing. The first vacuum chamber 28 is vented to atmosphere through conduit 52, first chamber 42, vent tube 46 and restricted opening 47. At the same time, the second vacuum chamber 29 is also connected to atmosphere through restricted opening 50, and therefore a small quantity of atmospheric air flows into the second vacuum chamber 29 through conduit 53, but the vacuum effect from the intake passage 11 proves much larger than that of atmospheric air, eliminating any cause of trouble. When the vehicle speed exceeds a predetermined value, the switch 61 opens, and this causes the three-way control valve 32 to supply engine intake vacuum pressure to the first vacuum chamber 28. The second vacuum chamber 29 is vented to atmosphere through conduit 53 and restricted opening 50. This causes the slide rod 22 to be moved toward the right to advance the spark timing. At the same time, atmospheric air flows through the restricted opening 47 and conduit 52 into the first vacuum chamber 28, but the vacuum effect from the intake passage 11 proves much larger than that of atmospheric air, eliminating any cause of trouble.

Having fully described my invention, it is to be understood that I am not to be limited to the details herein set forth, but that my invention is of the full scope of the appended claims.

I claim:

1. For use with an internal combustion engine connected to drive a vehicle, the engine having an intake passage for an air-fuel mixture and provided with a throttle valve, the improvement comprising, in combination: a vacuum line communicating with said intake passage downstream from said throttle valve, a three-way valve connected to said vacuum line, means including a movable member for controlling the ignition timing of said engine, a vacuum responsive device including a flexible diaphragm connected to said member, walls forming a spark advance chamber on one side of said diaphragm and forming a spark retard chamber on the other side of said diaphragm, a first conduit connecting said three-way valve to said spark advance chamber, a second conduit connecting said three-way valve to said spark retard chamber, means for moving said three-way valve in response to the vehicle velocity to connect said vacuum line to said first conduit when the vehicle velocity is above a predetermined valve or to said second conduit when the vehicle velocity is below said predetermined valve, means for venting said spark retard chamber through a restricted passage when the spark retard chamber pressure exceeds the pressure of said spark advance chamber, and for venting said spark advance chamber through a restricted passage when the spark advance chamber pressure exceeds the pressure of said spark retard chamber and a valve responsive to engine temperature acting to close said vacuum line when the engine temperature falls below a predetermined value.

2. For use with an internal combustion engine connected to drive a vehicle, the engine having an intake passage for an air-fuel mixture and provided with a throttle valve, the improvement comprising, in combination: a vacuum line communicating with said intake passage downstream from said throttle valve, a three-way valve connected to said vacuum line, means including a movable member for controlling the ignition timing of said engine, a vacuum responsive device including a flexible diaphragm connected to said member, walls forming a spark advance chamber on one side of said diaphragm and forming a spark retard chamber on the other side of said diaphragm, a first conduit connecting said three-way valve to said spark advance chamber, a second conduit connecting said three-way valve to said spark retard chamber, electromagnetic means for moving said three-way valve to connect said vacuum line to either said first conduit or to said second conduit, a valve responsive to engine temperature acting to close said vacuum line when the engine temperature falls below a predetermined value, means for venting said spark retard chamber through a restricted passage when the spark retard chamber pressure exceeds the pressure of said spark advance chamber, and for venting said spark advance chamber through a restricted passage when the spark advance chamber pressure exceeds the pressure of said spark retard chamber, and an electric circuit for operation of said electromagnetic means, and circuit including a switch sensitive to vehicle velocity and acting to de-energize said electromagnetic means when the vehicle velocity exceeds a predetermined value.

* * * * *

UNITED STATES PATENT AND TRADEMARK OFFICE

CERTIFICATE OF CORRECTION

PATENT NO. : 4,149,499

DATED : April 17, 1979

INVENTOR(S) : NORIMITSU KURIHARA

It is certified that error appears in the above-identified patent and that said Letters Patent are hereby corrected as shown below:

Column 4, lines 2 and 4, "valve" should read --value-- in both places.

Signed and Sealed this

*Tenth* Day of *July 1979*

[SEAL]

*Attest:*

*Attesting Officer*

LUTRELLE F. PARKER

*Acting Commissioner of Patents and Trademarks*